US007241478B2

(12) United States Patent
McNeish et al.

(10) Patent No.: US 7,241,478 B2
(45) Date of Patent: Jul. 10, 2007

(54) PROCESS FOR COATING THREE-DIMENSIONAL SUBSTRATES WITH THIN ORGANIC FILMS AND PRODUCTS

(75) Inventors: Allister McNeish, Austin, TX (US); Edmund Popp, Austin, TX (US); Mark Brown, Pflugerville, TX (US); Mark W. Leiby, Hyde Park, NY (US); James J. Cerul, Kingston, NY (US); Harvey L. Berger, Hyde Park, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/927,782

(22) Filed: Aug. 27, 2004
(Under 37 CFR 1.47)

(65) Prior Publication Data

US 2005/0158448 A1 Jul. 21, 2005

Related U.S. Application Data

(63) Continuation of application No. 10/084,293, filed on Feb. 25, 2002, now abandoned.

(51) Int. Cl.
*B05D 1/02* (2006.01)

(52) U.S. Cl. ..... 427/421.1; 427/2.1; 427/533; 427/294; 427/295; 427/296; 427/226; 427/227; 427/228; 427/229; 427/248.1

(58) Field of Classification Search ..... None
See application file for complete search history.

(56) References Cited

U.S. PATENT DOCUMENTS

| | | | | |
|---|---|---|---|---|
| 4,504,522 | A | 3/1985 | Kaiser et al. | 427/103 |
| 4,808,449 | A | 2/1989 | McAlister | 428/3.1 |
| 5,451,260 | A * | 9/1995 | Versteeg et al. | 118/725 |
| 5,821,402 | A | 10/1998 | Okajima et al. | 73/23.2 |
| 5,834,419 | A | 11/1998 | McFadden et al. | 514/2 |
| 5,972,430 | A | 10/1999 | DiMeo, Jr. et al. | 427/255.32 |
| 6,131,580 | A | 10/2000 | Ratner et al. | 128/898 |

(Continued)

OTHER PUBLICATIONS

Krumdieck et al., "Conversion efficiency of alkoxide precursor to oxide films grown by an ultrasonic-assisted, pulsed liquid injection, metalorganic chemical vapor deposition (pulsed-cvd) process", *J.Am. Ceram. Soc.*, 82:1605-1607, 1999.

(Continued)

*Primary Examiner*—Alain L. Bashore
(74) *Attorney, Agent, or Firm*—Mark Garrett; Fulbright & Jaworski LLP

(57) ABSTRACT

The present invention relates to an apparatus and process for producing a thin organic film on a substrate using an ultrasonic nozzle to produce a cloud of micro-droplets in a vacuum chamber. The micro-droplets move turbulently within the vacuum chamber, isotropically impacting and adhering to the surface of the substrate. The resulting product has a smooth, continuous, conformal, and uniform organic thin film, when the critical process parameters of micro-droplet size, shot size, vacuum chamber pressure, and timing are well-controlled, and defects such as "orange peel" effect and webbing are avoided. The apparatus includes an improved ultrasonic nozzle assembly that comprises vacuum sealing and a separate, independent passageway for introducing a directed purging gas.

4 Claims, 5 Drawing Sheets

U.S. PATENT DOCUMENTS

| | | | | |
|---|---|---|---|---|
| 6,134,791 | A | 10/2000 | Huang | 30/513 |
| 6,153,252 | A * | 11/2000 | Hossainy et al. | 427/2.3 |
| 6,265,222 | B1 | 7/2001 | DiMeo, Jr. et al. | 436/144 |
| 6,361,819 | B1 | 3/2002 | Tedeschi et al. | 427/2.24 |
| 6,596,236 | B2 | 7/2003 | DiMeo, Jr. et al. | 422/88 |
| 6,670,286 | B1 * | 12/2003 | Yang et al. | 438/780 |
| 2003/0161937 | A1 | 8/2003 | Leiby et al. | 427/2.24 |

OTHER PUBLICATIONS

Krumdieck, "Kinetic model of low pressure film deposition from single precursor vapor in a well-mixed, cold-wall reactor", *Acta Mater.*, 49:583-588, 2001.

Leiby, "A better way to produce thin-film protypes: a recent twist to chemical vapor deposition provides a versatile way to create thin-film circuits and other devices; Engineering Materials," *Machine Design*, 75:114, 2003.

Leiby, "Chemical vapor deposition by pulsed ultrasonic direct injection of liquid precursors produces versatile method for creation of thin film circuits and devices," apparently available on thinsonic-cvd.com in Jun. 2002.

Schmidmaier, et al., "Biodegradable poly(d,l-lactide) coating of implants for continuous release of growth factors", J. Biomed Mater Res. (Appl Biomater), 58:449-455, 2001.

* cited by examiner

PROCESS FOR COATING THREE-DIMENSIONAL SUBSTRATES WITH THIN ORGANIC FILMS AND PRODUCTS

CROSS-REFERENCE(S) TO RELATED APPLICATION(S)

This application claims priority to U.S. patent application Ser. No. 10/084,293, filed Feb. 25, 2002 now abandoned, the entire contents of which are expressly incorporated by reference.

FIELD OF THE INVENTION

The present invention relates to a process for producing a thin organic film on a substrate that is three-dimensional, such that the film has desirable qualities including surface smoothness, non-frangibility, uniform thickness and continuity and the unique products produced thereby. The process involves controlled application of a mixture of a volatile compound and a polymer precursor, using introduction through an ultrasonic nozzle of the mixture into a pressure controlled chamber, such that a vapor cloud of micro-droplets uniformly deposits as a thin organic film on the surface of a three-dimensional substrate. One embodiment includes a special ultrasonic nozzle configuration that improves repeatability and rate of production.

BACKGROUND OF THE INVENTION

The use of medical implants is a multi-billion dollar world-wide industry and the development of new applications is increasing rapidly. Medical implants include, among others, pacemakers, stents, drug delivery devices, and artificial organs.

One continuing problem in the implantation of devices within the body is the reaction of the body to the implanted device. For example, the body often rejects foreign objects implanted within the body, causing undesirable side effects that can injure a patient or require the administration of oral or intravenous medications to prevent rejection of the implanted device. Also, the implantation of stents within an artery or vein is often complicated by restenosis, a complication caused by the recurrence of plaque especially after balloon angioplasty coupled with stent implantation. For example, see U.S. Pat. No. 5,834,419, which issued to McFadden, et al. on Nov. 10, 1998, and is herein incorporated by reference in its entirety. A medication can be included in an organic coating that inhibits rejection of a medical device or inhibits restenosis at the location of a stent. However, this solution requires a tough, well-adhered, smooth, thin and continuous organic coating on the surface of the device or stent that can hold the inhibitor on the surface and/or release the inhibitor over time from the stent.

The process of coating a three-dimensional shape, such as a stent, with a uniform, continuous and conformal coating is a difficult one that has not heretofore been completely solved. Frequently, the process is complicated by the delicacy, intricacy, and ultimately in-vitro use of these medical devices. For example, a cardiac stent is normally compressed during catheterization, and when the stent is in position for emplacement, the stent is expanded by a balloon or other means, which opens the previously blocked or partially blocked vessel. A coating on the stent must be able to conform to the three-dimensional shape of the stent without interfering with the expansion of the stent, and the coating must remain adhered to the surface of the stent and must be continuous and smooth following expansion of the stent.

Another application requiring high quality coatings is the fabrication of surface acoustic wave sensors (SAWS) for detection of volatile compounds. SAWS resonate in the megahertz range, usually using piezoelectric materials to create the resonance. For example, a thin, chemically reactive coating of a particular organic compound allows the sensor to capture from the surrounding environment molecules of certain hazardous compounds or molecules associated with the presence of hazardous compounds. The sensor acts as a resonating mass microbalance. For example, see U.S. Pat. No. 6,314,791 to Rapp, et al., issued Nov. 13, 2001, which is incorporated herein by reference in its entirety. The presence of additional molecules that are captured by the surface coating registers as a change in the sound propagation speed of the surface wave, which can detect very low concentrations of the hazardous compounds. Intrinsically, this application requires an exceptionally adherent, thin, and uniform organic film that was difficult, if not impossible, to produce by any previously known process.

Until now, no deposition process satisfactorily achieved all of these objectives. Surface tension effects during deposition of an organic film often preferentially forms a meniscus or webbing at the interstices (which have a large negative curvature) of a three-dimensional substrate, such as can be found in a stent or medical device. Directed spray of liquid or semi-liquid droplets on a surface causes shadowing effects, which cause uneven or non-continuous coatings on the surface of a three-dimensional substrate.

A CVD process for coating a substrate using a liquid delivery System with an ultrasonic nozzle was disclosed in U.S. Pat. No. 5,451,260, which was filed on Apr. 15, 1994 and issued on Sep. 19, 1995, and is incorporated herein by reference in its entirety. This process produces a fine mist of very small droplets that rapidly evaporate in a vacuum chamber, such that only vapor comes in contact with the substrate. A uniform film then deposits on the substrate surface by a chemical vapor deposition process, whereby the vapor decomposes by pyrolysis, leaving a uniform metal oxide film on the surface. Although a uniform coating results on a flat surface, this process has the disadvantage of being a vapor deposition process, which can cause webbing at the interstices of a stent, for example. Furthermore, it does not allow for the deposition of a liquid that is not easily vaporized in a vacuum reaction chamber. Finally, it does not provide for pressure control during the drying of a liquid film on the surface of the substrate; therefore, vacuum levels sufficient to cause boiling on the surface of the substrate can cause an "orange peel" effect.

By "orange peer" the inventors mean that rapid volatilization of a solvent or other volatile compounds in a liquid film on the surface of a substrate can cause eruptions in the otherwise smooth and continuous coating. These eruptions are often not completely refilled by the surrounding liquid, leaving indentations on the surface that appear under magnification to resemble the irregular dimpling in the peel of an orange. If the coatings are required to be smooth, this dimpling is a cause for rejection of the coated device.

SUMMARY OF THE INVENTION

The present invention is directed to a process of producing a high quality, organic thin film on complex, three-dimensional substrates. The process can be used to deposit a variety of thin films or coatings on three-dimensional substrates for use in a variety of applications, including coating stents with a restenosis inhibiting film, providing a surface coating for a SAWS, depositing an organic layer on micro-electro mechanical systems (MEMS), and depositing an organic layer or multiple organic layers on optical and electro-optical devices.

One typical embodiment of the process comprises the introduction of a measured volume of a volatile liquid mixed with an organic compound or multiple organic compounds, which may be liquid, solid, in solution with the volatile liquid or any combination of liquid, solid and in solution, through an ultrasonic nozzle, while the temperature and pressure is controlled within an enclosed volume, creating a cloud of microdroplets within the enclosed volume containing a substrate. The pressure of the enclosed volume is controlled to cause a controlled rate of vaporization of the volatile compound from the microdroplets. Under controlled conditions, the speed and directions of microdroplets is observed to be highly turbulent and isotropic, and the micro-droplets isotropicly impact the surface of the three-dimensional substrate, causing a smooth, uniform, continuous, and conformal thin film of the organic compounds and any remaining volatile liquid on the substrate, even when the substrate is a complex, three-dimensional shape. Although this is not intended to restrict the scope of the invention, the inventors believe that the vaporization of the volatile compound contributes to the turbulent motion of the micro-droplets.

In one embodiment, after some of the micro-droplets isotropically impact the surface and a thin film is developing on the substrate surface, the pressure in the enclosure may be changed to alter the rate of volatilization. As an example, the enclosure pressure can be increased by introducing an inert gas to reduce the rate of volatilization. In an alternative embodiment, an inert gas can be used to purge the enclosure by introducing the inert gas at one side of the enclosure while evacuating the purge gas from another side of the enclosure, which acts to dry the liquid film more rapidly. In yet another alternative embodiment, a reactive gas can be introduced, which reactive gas reacts with the surface film. For example, the reaction can be a polymerization reaction.

In one preferred embodiment of the invention, the substrate is a stent. In another preferred embodiment, the substrate is a SAWS. In yet another preferred embodiment, the substrate is an optical device.

In one particular embodiment, the organic compound is a polymer. In another particular embodiment, the organic compound is a polymer that is soluble in the volatile liquid. In yet another embodiment, the organic compound is a monomer.

In another particular embodiment, an apparatus is used that comprises at least one ultrasonic nozzle. For example, a piezoelectrically operated ultrasonic atomizing nozzle such as those manufactured by SONO-TEK Corporation of Milton, N.Y.

One object of the invention is to provide for a process of coating a three-dimensional substrate that produces a thin, smooth, continuous, and conformal coating. One specific object is an organic coating that contains a medicament that prevents undesirable complications, such as rejection or restenosis. Another object is to provide a method of coating optical surfaces. Another object of the invention is to provide a method of production of surface acoustic wave sensors for detection of hazardous and/or non-hazardous compounds. Yet another object of the invention is to control the deposition concentration of the micro-droplets, the deposition rate, and the rate of drying of the deposited organic thin film to control the morphology of the organic thin film. For example, the morphology of the organic thin film directly relates to the rate of elusion and erosion of the organic thin film during use in an application, and by controlling the morphology of an organic thin film it is possible to produce a coating that affects elusion and/or erosion.

BRIEF DESCRIPTION OF THE FIGURES

For the purpose of illustrating the invention, representative embodiments are shown in the accompanying figures, it being understood that the invention is not intended to be limited to the precise arrangements and instrumentalities shown.

DETAILED DESCRIPTION OF THE PREFERRED EMBODIMENTS

Figure 1:
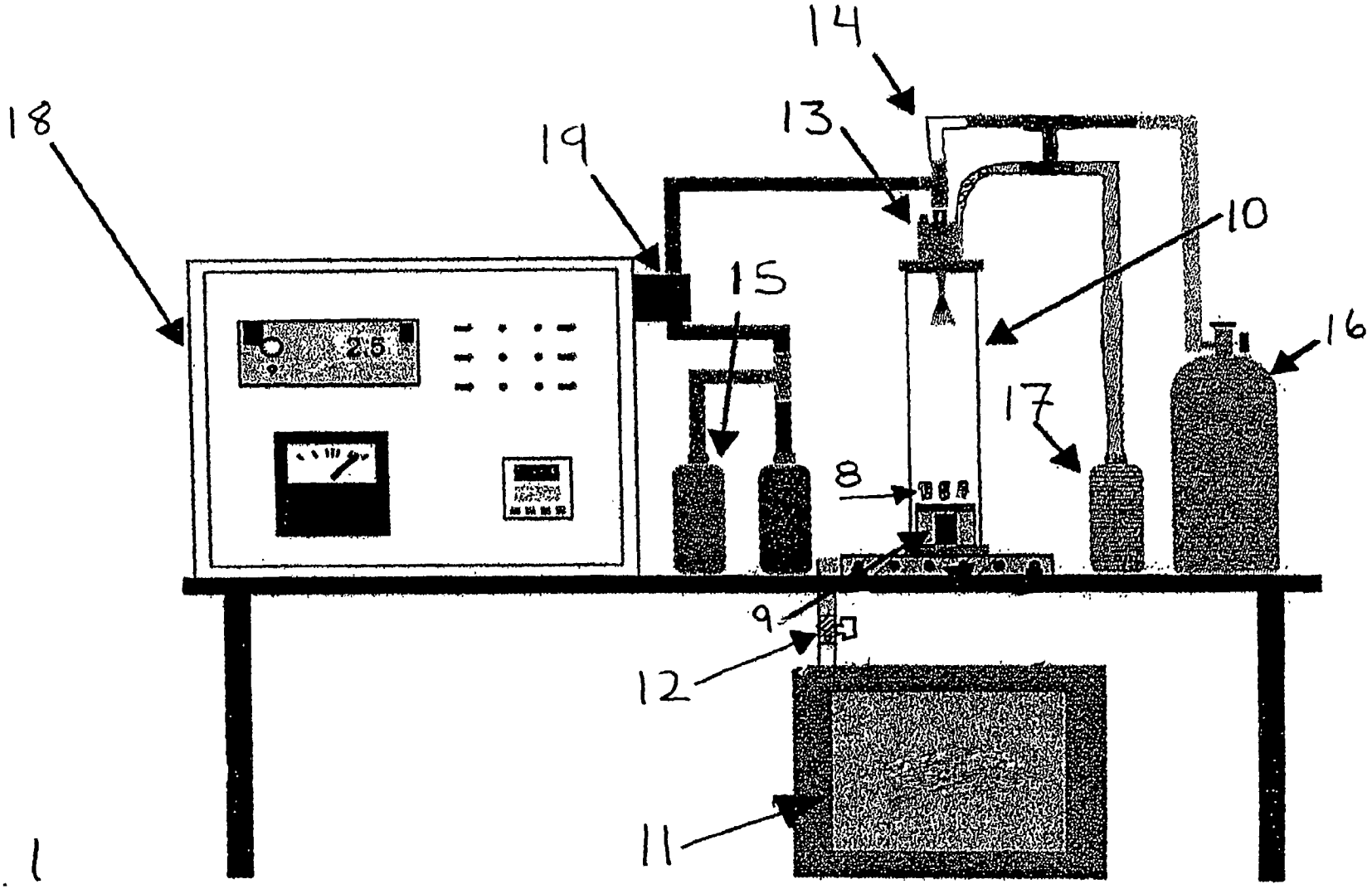
FIG. 1 is a schematic view of one embodiment of the apparatus used to deposit organic thin films on three-dimensional substrates.

The present invention will now be described in detail for specific preferred embodiments of the invention. These embodiments are intended only as illustrative examples and the invention is not to be limited thereto.

The most critical processing conditions are the type of nozzle selected, the ultrasonic frequency selected for the ultrasonic nozzle, the choice of a volatile liquid, the choice and concentration of organic compounds mixed with the volatile liquid, the pressure within the enclosure, the temperature within the enclosure, and the timing of changes in the processing conditions.

In a first example of the invention, it was desired that a thin film comprising an organic compound and a medication be completely continuous and conformal on the surface of a three-dimensional substrate; therefore, it was desirable that the micro-droplets had retained a significant portion of the volatile liquid upon impact with the substrate, allowing the liquid film to wet the surface and flow across the surface of the substrate. In a second example of the invention, the uniformity of the thickness of the coating was critical; therefore, it was desirable that the micro-droplets impact the surface in a state that was nearly free of the volatile liquid (referred to elsewhere herein as a "dry" condition, regardless of the liquidity of the organic compounds upon impacting the surface), wherein the film did not flow as much as the film in the first example. The processing conditions for these two examples illustrate the range of conditions and motivations for selecting certain values within these ranges, and these two examples will be presented in detail later.

In one typical embodiment, a three-dimensional substrate is enclosed in a chamber, and the chamber, also referred to herein as the enclosure, is evacuated. A mixture comprising a volatile liquid and at least one organic compound is metered into a closed reservoir, referred to herein as the "calibrated dispense volume." The chamber is brought to an introduction pressure by adding argon or further evacuating the chamber. Generally, it is preferable that the pressure in the chamber be less than the ambient atmospheric pressure. More preferably, a chamber pressure is selected that produces an energetic, turbulent, and isotropic movement of the micro-droplets that will form during introduction of the mixture through the ultrasonic nozzle. The choice of this enclosure pressure depends on the size of the droplets, which depends on the ultrasonic frequency, and on the desired wettability and flowability of the micro-droplets after impacting with the substrate. The wettability of the micro-droplets on a substrate depends upon the surface tension between the substrate surface and the vapor in the chamber, the surface tension between the substrate surface and the micro-droplets, and the surface tension between the micro-droplets and the vapor in the chamber. Generally, it is desired that the micro-droplets wet the surface. In one typical embodiment wettability is enhanced by precoating the substrate with a coating that improves the wettability of the desired organic thin film In a typical preferred embodiment, the initial range of chamber pressures is between about 2 mTorr (milliTorr) and 200 Torr. During introduction of the mixture of the volatile liquid and organic compound or compounds, the pressure in the chamber increases, if the volume is constant. In an alternative embodiment, a valve to a vacuum pump and a valve to a source of gas are metered to select desired chamber pressures during the process. For example, a first pressure is selected initially to create a cloud of micro-droplets and a second pressure is selected for drying of the thin film by purging the chamber with an inert gas, reducing the drying time. The inventors use the term introduction of the mixture through the ultrasonic nozzle to distinguish this from other processes that forcefully introduce a stream or spray. The low velocity, non-directional introduction of the liquid mixture in the form of micro-droplets is believed to be important in the high quality of the organic thin films obtained by the invention.

In another embodiment, the liquid introduced into the chamber, in this case referred to as a reaction chamber, comprises an organic liquid that undergoes a chemical reaction The micro-droplets isotropically impact the surface, producing an organic thin film that is a product of the reaction involving the organic liquid The reaction can occur before, after or both before and after deposition on the substrate. In this embodiment, either the organic liquid or a product from the reaction of the organic liquid, is volatile, contributing to the turbulent motion of the micro-droplets. For example, a hydroxy-functionalized silane can be introduced. It is believed that the hydroxy-functionalized silane undergoes a decomposition reaction forming an organic thin film on the substrate. In another embodiment, the organic liquid can react with a gaseous phase introduced into the reaction chamber as a reactant.

Figure 4:
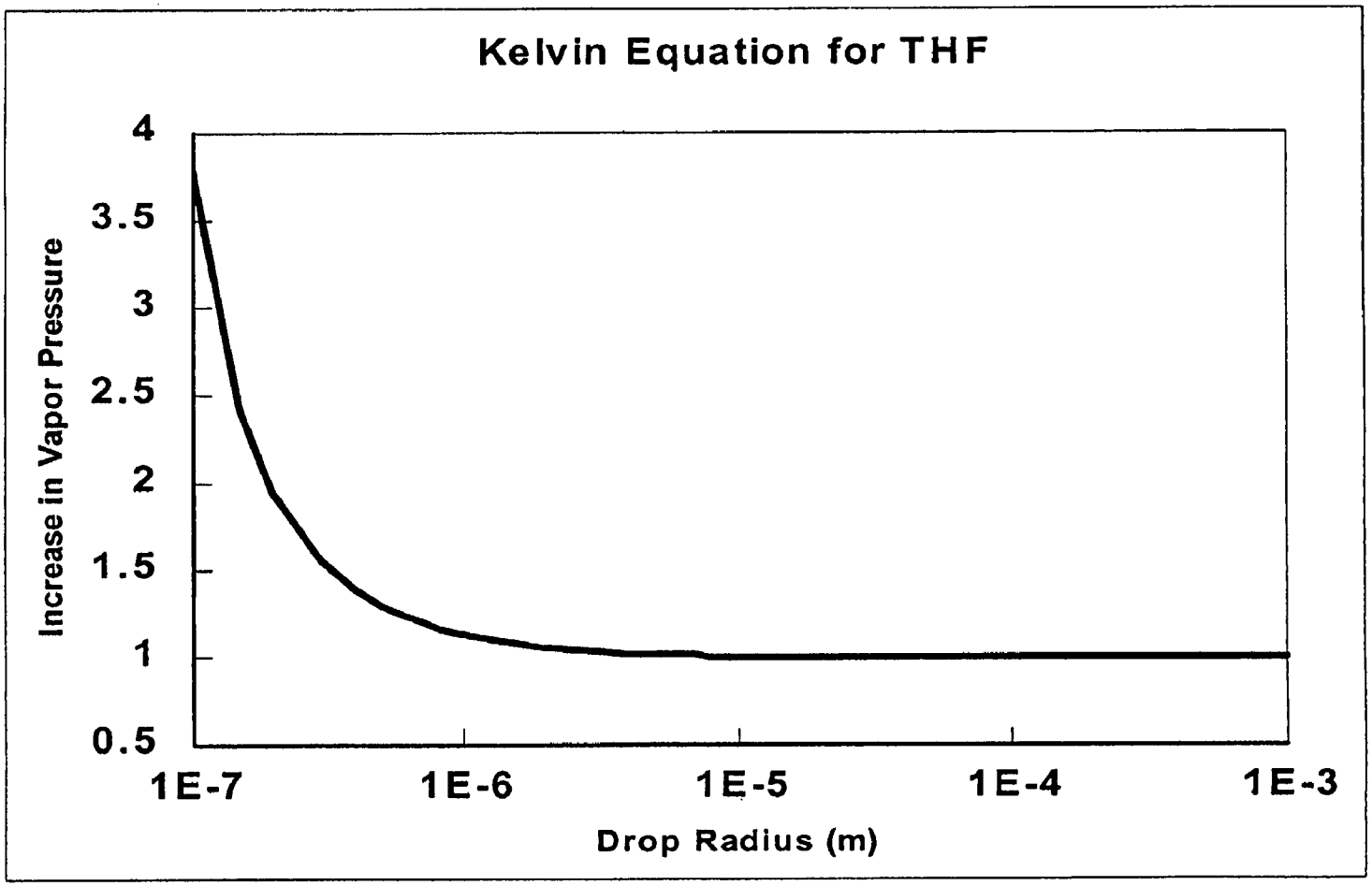
FIG. 4 shows a graph of the normalized vapor pressure versus micro-droplet size for tetrahydrofuran (THF).

In yet another embodiment, tetrahydrofuran (THF) is introduced in liquid form FIG. 4 shows the change in vapor pressure with droplet size for THF. Micro-droplets of THF have a comparatively high vapor pressure as the micro-droplet size decreases. The effect of micro-droplet size on vapor pressure shown in FIG. 4 is a typical relationship for liquids, because the vapor pressure typically increases with increasing positive curvature.

Figure 5:
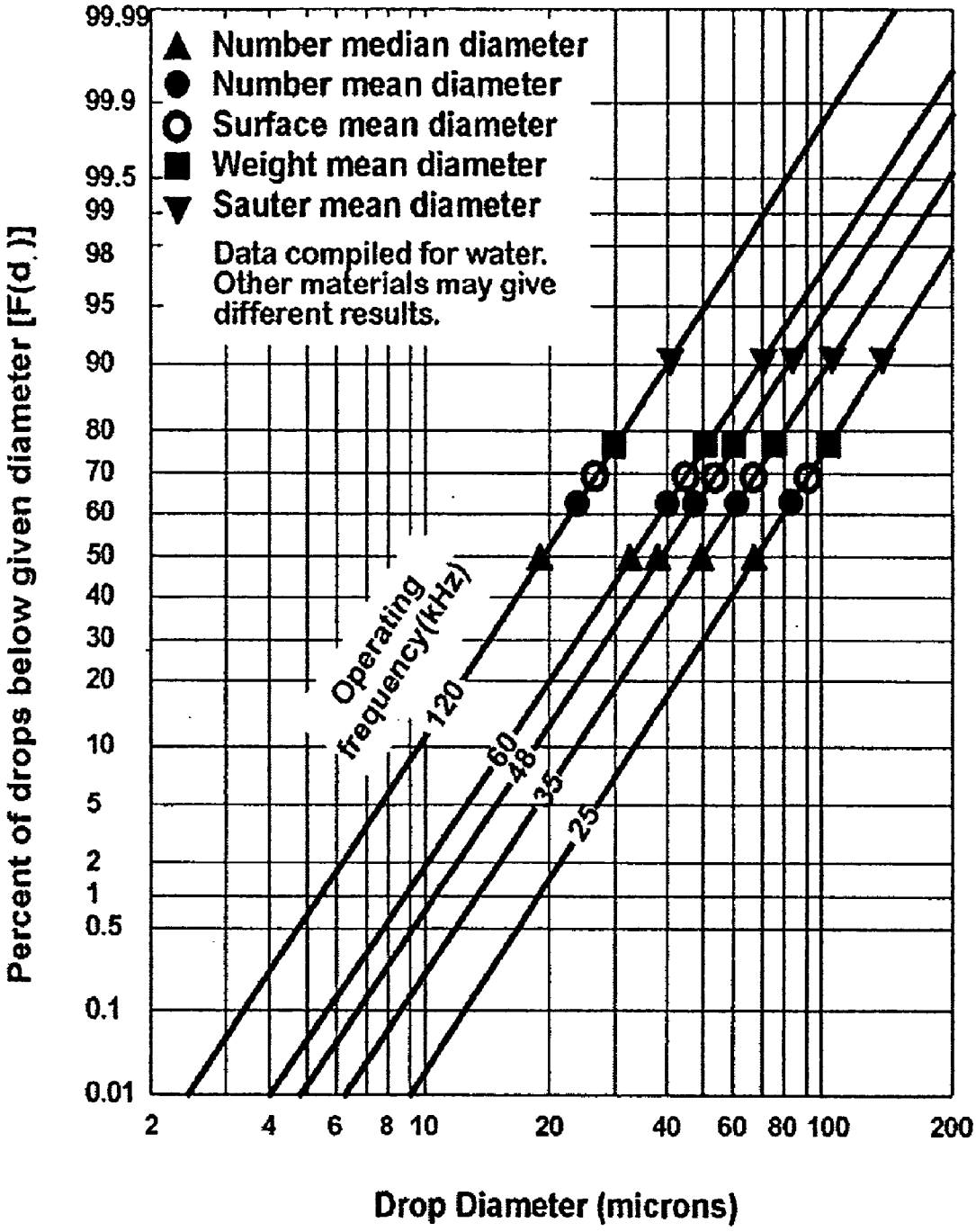
FIG. 5 shows a graph illustrating the effect of ultrasonic frequency on micro-droplet size, including distribution and mean micro-droplet diameter.

One embodiment of the invention uses an ultrasonic frequency of 120 kHz. Another embodiment of the invention uses an ultrasonic frequency of 60 kHz. In yet another embodiment of the invention a range of ultrasonic frequencies can be selected, depending on the desired size of the micro-droplets upon impact. Generally, the smaller the desired droplet size, the higher the ultrasonic frequency that should be used; however, this depends on the characteristics of the mixture of the volatile liquid and the organic compounds contained within the volatile liquid, particularly the surface tension and viscosity of the mixture. FIG. 5 illustrates the mean size and distribution of micro-droplets at various ultrasonic frequencies. The median particle diameter (D) depends on the surface tension ($\gamma$), liquid density ($\rho$) and ultrasonic frequency (f) according to the following equation: $D=0.34\ [(8\cdot\pi\cdot\gamma)/(\rho\cdot f^2)]^{1/2}$. A preferred range of micro-droplet sizes for producing a uniform, thin coating includes micro-droplets with diameters of less than 100 μm (microns). It should be understood that these micro-droplet diameters are approximations, because the micro-droplets are not truly spherical. The inventors believe that it is more appropriate to refer to micro-droplet diameter as a "micro-droplet size," meaning the approximate mean diameter of a spherical droplet having an equivalent mass to the micro-droplet. Indeed, the size of the droplets changes with time, as the volatile liquid evaporates from the micro-droplet, and the inventors usually control the ultrasonic frequency and micro-droplet viscosity to achieve a high quality film, as determined by optical microscopy, without resorting to actual measurements of micro-droplet size. However, preferred range of micro-droplet size is included here for completeness. A range of micro-droplet size between about 1 μm and 60 μm is preferred for many applications. One preferred micro-droplet size for coating stents is a micro-droplet size of about 20 μm. Micro-droplets of about this size can be generated in many typical mixtures of volatile solvents and organic compounds at about 120 kHz. Generally, very high ultrasonic frequencies of about 1 MHz are required to reduce particle size to about 1 μm, and large particles of 60 μm are produced at a frequency of about 25 kHz.

Furthermore, it should be understood that particle size will effect the kinetics of the particle movement, the rate of volatilization of the volatile liquid from the droplets, the thickness of the film, and the rate of drying or any rate of reaction within the film or between the film and any reactive compound introduced during the process. Therefore, changing the frequency or material characteristics of the mixture of volatile liquid and organic compounds can require modification of the amount of the mixture introduced to the chamber, the pressure control, any purging times, and any reaction times involved in a particular process.

Some typical examples of a volatile liquid used as a solvent include, but are not limited to, ethyl alcohol, methyl alcohol, acetone, water, toluene, chloroform, tetrahydrofuran (THF) and mixtures thereof Any organic compound or compounds can be deposited onto the surface of the substrate. Some examples include, but are not limited in any way to, Teflon, a polyurethane, an acrylic, an epoxy resin compound, Nylon, a polyester, polyvinylalcohol, polyethylene, monomers that react to form one or more of these polymers on the surface of the substrate, and copolymers of these. Also, polymer precursors may be dissolved in volatile liquids, and polymerization or cross-linking of polymer chains can take place before, during or after the micro-droplets impact the substrate surface.

In addition, in one specific embodiment multiple nozzles can be used for separately introducing constituent organic compounds independently into the enclosure, such that a polymerization reaction occurs at the surface of the substrate during deposition of the thin film. For example, a two-part epoxy resin coating could be deposited onto a surface using two separate nozzles.

Furthermore, in alternative embodiments of the invention, multiple layers of organic compounds can be alternated with layers of the same organic compounds, different organic compounds, or even inorganic compounds. For example a layer of indium tin oxide can be deposited, which is an electrically conductive inorganic oxide, which can be used as a transparent electrical contact. For a process of depositing a metal oxide using CVD, See U.S. Pat. No. 5,451,260, which is incorporated herein in its entirety by reference.

One significant difference between the process of MOCVD and the present invention is that the present invention operates in a regime where micro-droplets impact on the surface of a three-dimensional substrate, whereas the MOCVD process operates in the vapor state. Also, the vapor in MOCVD must decompose, usually by pyrolysis, to deposit a layer on a substrate; however, the present invention does not require a decomposition reaction to deposit an organic thin film on a substrate. Instead, micro-droplets impinge directly on the surface of the substrate. Therefore, the processing conditions, the apparatus and the final products are substantially different between these two processes.

Figure 3:
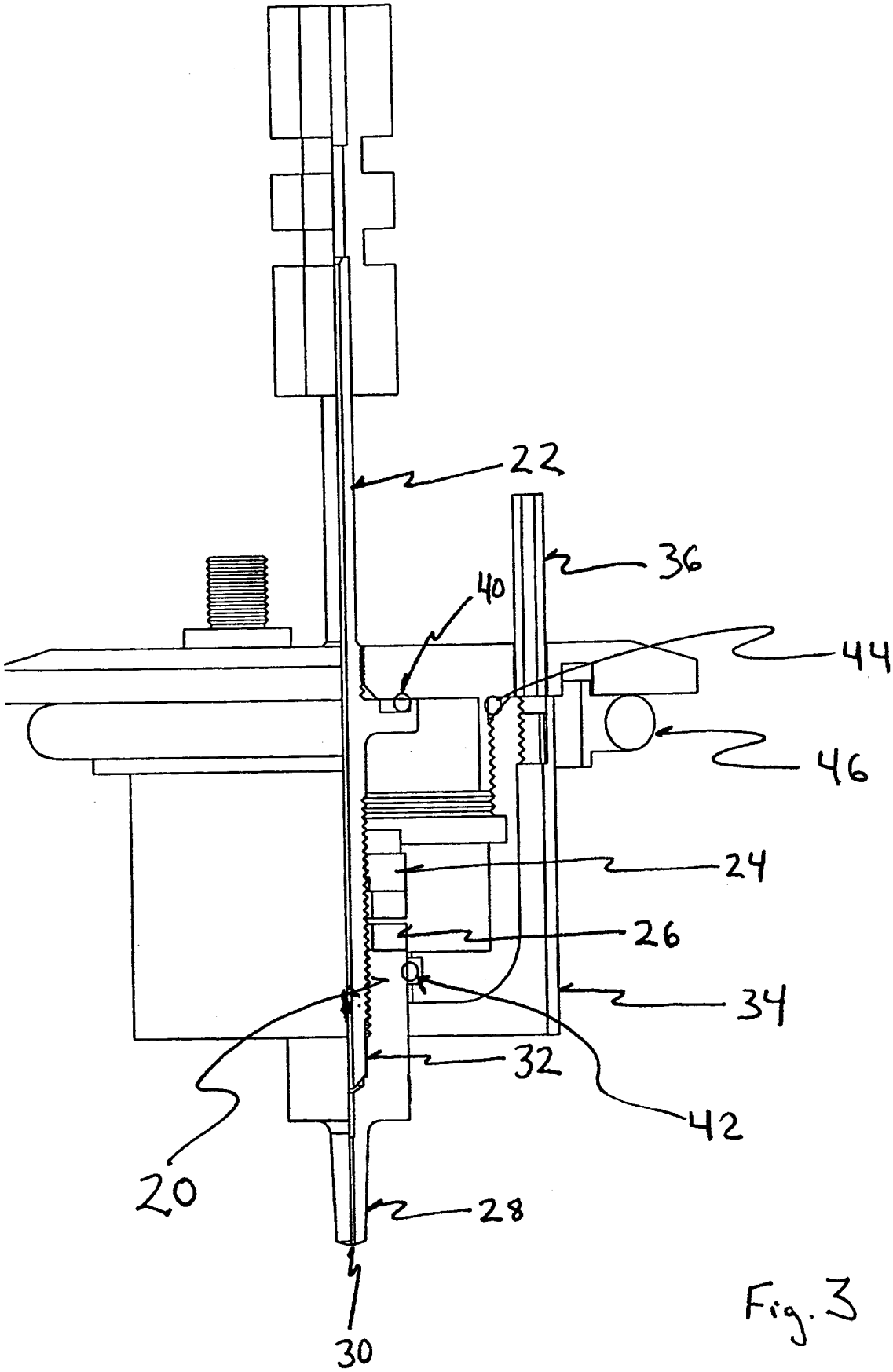
FIG. 3 shows a partial cutaway view of an improved ultrasonic nozzle for use in coating three-dimensional substrates with organic thin films.

In one specific embodiment of the invention, a new ultrasonic nozzle assembly is used that allows a gas to purge the vacuum chamber without passing through the nozzle itself. Instead, the gas bypasses the nozzle, but a gas passageway in the ultrasonic nozzle assembly directs the flow of the gas around the output section of the ultrasonic nozzle. See FIG. 3. Specifically, the ultrasonic nozzle assembly comprises a feed line 22, a front ultrasonic horn section 20, a rear ultrasonic horn section 24, at least one piezoelectric element 26, an output section 28 extending from the front ultrasonic horn section and terminating in an atomizing surface. The feed line has a liquid passage 30 extending axially from the coupling end through the feed line and out of the output section end, and the feed line output section end couples with the output section forming a metal to metal seal 32 with the output section. Then, the liquid passage of the ultrasonic nozzle extends axially through the combined feed line and output section, through the rear horn section, the front horn section and the atomizing surface of the output section. The piezoelectric element 26 is sandwiched between the front horn section and the rear horn section. The housing 34 provides a coupling 36 to a source of gas for purging of the vacuum chanter. The gas can be either an inert or a reactive gas, depending on the process. The housing of the ultrasonic nozzle assembly 34 encloses the rear horn section 24 and the piezoelectric element 26 and provides vacuum seals 40,42,46 for the feedline 22, where it exits the housing 40, the output section 28, where it enters the vacuum chamber 42, and the vacuum chamber, where it connects to the housing 46. In addition the housing provides a path for the source of gas to pass through the housing and into the vacuum chamber. The direction and location of the gas as it enters the vacuum chamber is controlled by the location and size of the purging gas ports in the housing (not shown in FIG. 3). In one particular embodiment the purging gas ports direct the gas around the ultrasonic nozzle and past the output section for purging of the vacuum chamber with the gas.

A schematic of one embodiment of the apparatus used to coat a three-dimensional substrate with a organic thin film is shown in FIG. 1. In one typical embodiment, the apparatus for coating a three-dimensional substrate with an organic thin film comprises a vacuum chamber 10 that is connected to a vacuum pump 11 by a vacuum valve 12, at least one ultrasonic nozzle 13 that extends into the vacuum chamber 10, a calibrated dispense volume 14, one or more sources of a mixture 15 of one or more volatile liquids and one or more organic compounds, a minimum of two fluid valves for delivering a controlled amount of the mixture first into the calibrated dispense volume and then into the vacuum chamber through the ultrasonic nozzle. In addition, a source of an inert gas is part of a typical embodiment. In a preferred embodiment, the source of inert gas 16 is used to introduce the mixture from the calibrated dispense volume into the vacuum chamber. In an alternative embodiment any pressure could be used to introduce the liquid, including but not limited to a syringe, pump, solenoid or vacuum pressure. Furthermore, a typical preferred embodiment has a gas valve that connects a source of gas 17 to the vacuum chamber for purging of the vacuum chamber. In a preferred embodiment, a process control system 18 controls the vacuum pressure of the vacuum chamber by actuating the vacuum valve and the at least one gas valve, and the process control system sequentially actuates the first and second valves causing a metered amount of the mixture to enter first the calibrated dispense volume through the first valve, and then the inlet end of the ultrasonic nozzle by the second valve. The mixture is introduced into the vacuum chamber through the ultrasonic nozzle, which causes the liquid to atomize into a cloud of micro-droplets that subsequently impact the three-dimensional substrate isotropically, coating the three-dimensional substrate with a uniform, organic thin film.

Specific Processing Examples and Results

Specific examples of processing conditions used to produce a thin organic coating will now be presented. These examples are provided merely as illustrative examples and the invention is not to be limited thereto.

Figure 2:
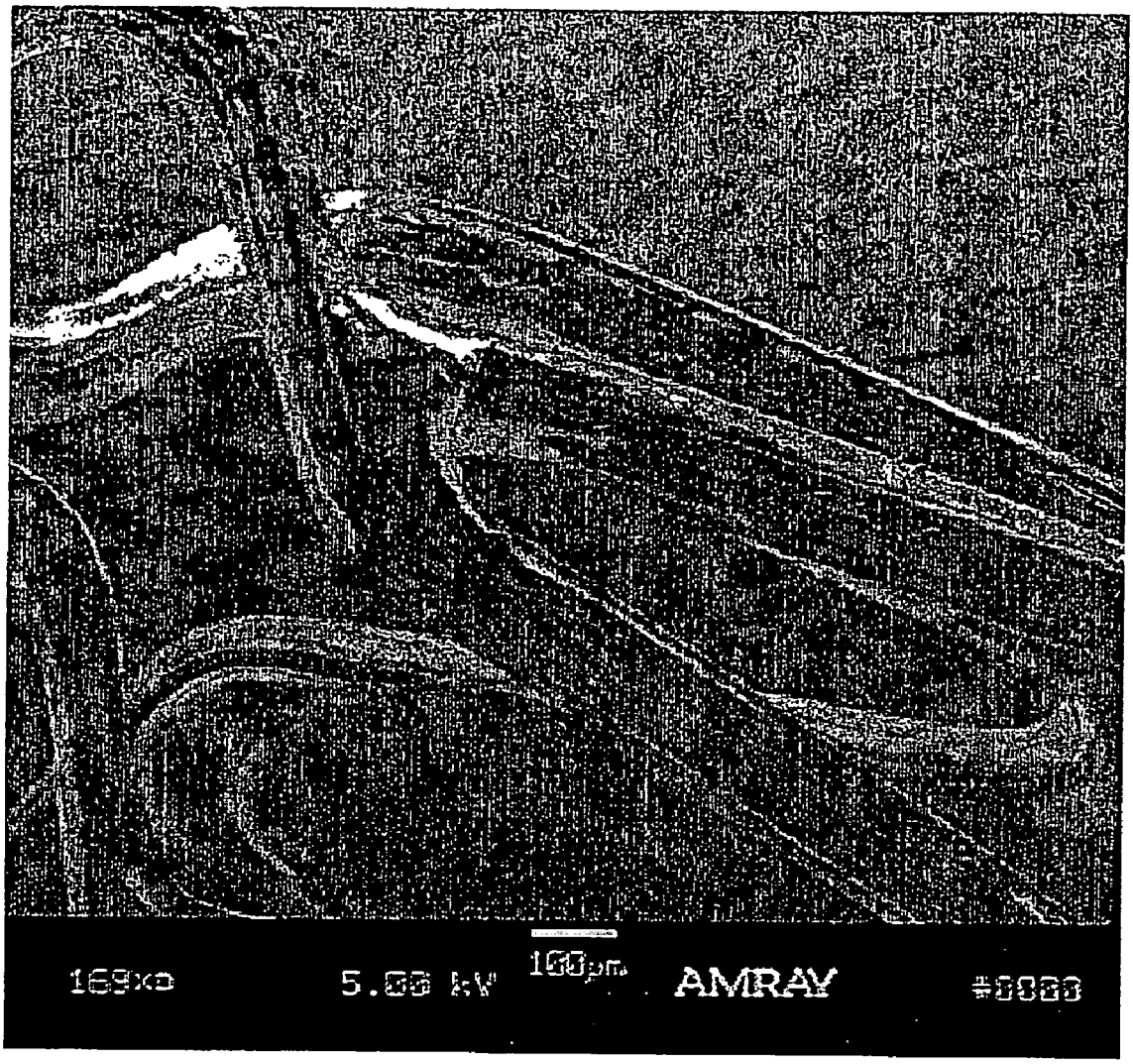
FIG. 2 is a micrograph of a stent coated with a polymer film.

The first specific example is a process for coating a stent with a uniform, polymer thin film, which could act as a restenosis inhibiting layer by incorporation of a restenosis inhibitor into the thin film. Several uncoated stainless steel alloy stents were placed in a quartz chamber, and the chamber was purged of air and evacuated to an initial static pressure of one Torr for each experimental run. Then, mixture of Tetrahydrofuran (THF) and a polymer was metered into the calibrated dispense volume. A quantity of the mixture was introduced into the chamber, forming a cloud of micro-droplets. After the cloud of micro-droplets deposited on the surface of the stents, argon purged the volume in the chamber. Then, the stents were allowed to cure in argon, air or a combination of argon and air for a duration not exceeding one hour. The stents were weighed on a microbalance to determine the increase in weight associated with the polymer coating, which is related to the coating thickness. Then, the process was repeated with the same stents (now coated with a thin layer of polymer). Each coating was subsequently weighed, and the variation in weight of deposited polymer was calculated. Each measurement was within a few percent of the mean for each stent, indicating that the process was uniform between coatings and among the various stents. Futhermore, optical and SEM micrography of the surface of the stents showed that the coatings were uniform, continuous, and conformal to the surface of the stents, FIG. 2.

The shot size means the amount of the mixture introduced into the chamber per cycle, and the number of shots indicates the number of repetitions or number of cycles of the process that were used to coat the stents before the surface quality of the stents was characterized In the first example, the complex three-dimensional shape and the requirement that the film conform to the three-dimensional shape meant that wetting and flowability of the film was necessary to achieve a good continuous, conforming organic thin film. The shot size used in this specific example ranged from 40 to 750 μl (microliters). The number of cycles ranged from 10 to 30. Typically the concentration of polymer in the volatile liquid solvent was 0.5%–1% by weight. For the number of stents that were typically placed in the chamber in these examples, typically 3–4, the transfer efficiency was in the range 0.3–0.9% per stent. It is believed that this efficiency would proportionately increase with an increasing density of stents in the chamber, at least to a reasonable limit.

As a second example, SAWS were coated with a thin polymer film In this example, very thin, highly uniform organic films were desired. Various organic polymer films were used that could react with the volatile organic compounds to be detected by the SAWS. In one example, the volatile solvent was chloroform, having a polymer in dilute solution. In another example the volatile solvent was THF. Each shot size (the amount of the mixture metered into the calibrated dispense volume per cycle) was programmed to be 20 μl. The ultrasonic frequency was 120 kHz. A satisfactory surface quality with a uniform layer thickness in the range between 0.001 and 0.5 μm was achieved by increasing the number of cycles and the concentration of polymer to volatile liquid. In this example, it was desirable for the micro-droplets to be nearly dry (little remaining volatile liquid) at the time of impact on the surface of the substrate, and it was preferred that the chamber be saturated with a volatile organic compound, such as THF, at the time of impact on the surface of the substrate.

Although the present invention has been described in terms of preferred embodiments and examples, it will be understood that numerous modifications and variations could be made thereto without departing from the scope of the invention as set forth in the following claims.

What is claimed is:

1. A process for coating a substrate with an organic thin film, comprising:

placing a substrate in a vacuum chamber;

preparing a mixture of at least one volatile liquid and at least one organic compound;

metering the mixture into a calibrated dispense volume;

evacuating the vacuum chamber;

purging the vacuum chamber with an inert gas;

bringing the level of pressure in the vacuum chamber to a controlled pressure;

introducing the mixture into the chamber through an ultrasonic nozzle, wherein a cloud of micro-droplets form and isotropically impact on the substrate, and wherein the substrate is coated with an organic thin film; and drying the organic thin film;

wherein the substrate is a SAWS.

2. The process of claim 1, wherein the SAWS is coated with an organic compound that captures a particular hazardous compound.

3. A process for coating a substrate with an organic thin film, comprising:

placing a three-dimensional substrate in a vacuum chamber;

preparing a mixture of at least one volatile liquid and at least one organic compound;

metering the mixture into a calibrated dispense volume;

evacuating the vacuum chamber;

purging the vacuum chamber with an inert gas;

bringing the level of pressure in the vacuum chamber to a controlled pressure;

introducing the mixture into the vacuum chamber through an ultrasonic nozzle;

controlling the pressure in the chamber to form a cloud of micro-droplets that isotropically impact on the substrate and coat the substrate with a generally conformal organic thin film; and drying the organic thin film;

wherein the substrate is a SAWS.

4. The process of claim 3, wherein the SAWS is coated with an organic compound that captures a particular hazardous compound.

* * * * *